US005188720A

United States Patent [19]

Colin et al.

[11] Patent Number: 5,188,720

[45] Date of Patent: Feb. 23, 1993

[54] INSTALLATION AND PROCESS FOR ELECTROLYTIC COATING OF A METAL STRIP

[75] Inventors: Gerard Colin; Jacques Keller, both of Florange, France

[73] Assignee: Sollac, Paris, France

[21] Appl. No.: 604,675

[22] Filed: Oct. 26, 1990

[30] Foreign Application Priority Data

Oct. 27, 1989 [FR] France ..... 89 14167

[51] Int. Cl.[5] ..... C25D 17/00

[52] U.S. Cl. ..... 204/206

[58] Field of Search ..... 204/206

[56] References Cited

U.S. PATENT DOCUMENTS 4,500,400 2/1985 Komoda et al. .

FOREIGN PATENT DOCUMENTS 0254703 1/1988 European Pat. Off. .

*Primary Examiner*—T. M. Tufariello

*Attorney, Agent, or Firm*—Fay, Sharpe, Beall, Fagan, Minnich & McKee

[57] ABSTRACT

The installation comprises a set of radial type cells (25*a*, 25*b*). The electrical supply of the strip (16) to be coated constituting the cathode is ensured by way of two electrically conducting deflector rollers (20) each mounted rotatably about an axle parallel to the axle of the drum (8) of the electrolysis cell. The deflector rollers (20) are arranged at least in part below the upper level of the drum (8) close to its outer surface. Two support rollers (21*a*, 21*b*) associated with each of the deflector rollers ensure the holding of the strip against the deflector roller over a substantial part of its periphery and as far as a zone close to the part of the outer surface of the drum (8) which is submerged in the electrolytic liquid (2). The invention applies in particular to the electrogalvanizing of a steel sheet.

8 Claims, 5 Drawing Sheets

INSTALLATION AND PROCESS FOR ELECTROLYTIC COATING OF A METAL STRIP

The invention relates to an installation for electrolytic coating of a metal strip and, in particular, an installation for electrogalvanizing a steel strip.

The invention also relates to a coating process employed in this installation, in particular in order to carry out the electrogalvanizing of a steel strip.

Processes and devices are known for carrying out the electrolytic coating of a continuous steel strip, this strip being circulated so as to cross one or, preferably, more successive electrolytic cells in which the coating metal is deposited on both faces of the strip simultaneously, or on only one of the two faces.

In particular, such processes have been applied in order to deposit a metal such as zinc or a zinc-based metal alloy containing nickel or iron, on one or both faces of a steel strip.

Customer requirements as regards the quality of coated metal sheets or bands, and the diversity of products as regards both their dimensional characteristics and their composition have led producers of coated metal sheets and, in particular, producers of galvanized metal sheets, to seek processes and installations guaranteeing high quality of products and offering high flexibility of use.

In particular, installations and processes used in the future will have to enable the production of metal sheets comprising a single-face coating or a two-face coating of very high quality, consisting of either pure zinc, or a zinc alloy containing nickel or iron. These metal sheets must exhibit very good dimensional tolerances, very good quality borders and the coating must exhibit a perfectly defined and perfectly regular thickness in all parts of the metal sheet produced. Furthermore, this coating must not exhibit longitudinal marks capable of spoiling the appearance and the quality of the product.

Finally, it is desirable to obtain improved mechanical characteristics for coated metal sheets and, in particular, to be able to guarantee an elastic limit for the metal sheet at a required level.

In certain particular cases, it may also be necessary to produce metal sheets coated by alloys of differing natures on each of their faces.

The currently known processes and installations do not enable all of the requirements formulated by the customers to be met.

The known processes and devices, which are extremely varied, use fixed electrodes brought to an anodic potential relative to the strip which constitutes a moving cathode circulating, over part of its course, in the vicinity of the active surface of the anodes. The anodes and the strip to be coated are therefore electrically connected to the corresponding terminals of a source of direct electric current capable of passing a very high intensity electrolysis current through an electrolytic liquid layer interposed between the anodes and the surface of the strip to be coated, this liquid generally being circulated so as to improve its contact with the active surfaces and ensure its renewal.

The electrolytic liquid is contained in a tank inside which the strip is made to circulate close to the active surfaces of the anodes which are completely immersed in the electrolytic liquid.

The various known processes and devices differ from one another mainly by the shape and position of the anodes, by the means for guiding the strip inside the tank filled with electrolytic liquid, by the means for supplying the strip with cathodic current, by the use of soluble anodes or, on the contrary, insoluble anodes, and by the nature of the electrolyte used.

In the case where soluble anodes are used, the coating metal is carried into the electrolyte by the electrolysis current between the anode and the strip brought to a cathodic potential, whereas in the case of insoluble anodes, the coating metal comes from the electrolytic bath itself, which must be continuously regenerated.

Certain coating installations comprise anodes having plane active surfaces between which the metal sheet to be coated passes. These anodes may be arranged either vertically or horizontally and the corresponding electrolysis cells are designated vertical cells or horizontal cells.

In most cases, the coating is performed on both faces of the strip simultaneously.

Another type of installation is known comprising soluble anodes in the form of ring segments. The electrolysis cells, designated radial cells, are each constituted by a tank containing an electrolytic liquid in which the anodes are immersed defining an active interior surface in the form of a cylinder segment, opposite which is displaced one face of the strip to be coated, the width of the gap between the inner face of the anodes and the surface to be coated being substantially constant. A drum rotatably mounted about a horizontal axle and substantially coaxial with the interior surface of the anodes is arranged inside the tank, so as to be partially submerged in the electrolytic liquid. This drum ensures the displacement of the strip inside the electrolytic cell. The electrolysis current crosses the space of annular shape and constant width lying between the interior surface of the anodes and the surface of the strip to be coated, in the radial direction of the drum which defines the cylindrical winding surface of the strip.

This process offers advantages in so far as the space lying between the electrodes and in which the electrolyte is circulated, may be kept at a substantially constant value, practically independent of the flatness and of the state of tension of the strip which is hard up against the drum.

Moreover, this type of installation with radial cells is particularly well suited for carrying out a coating on a single face of the strip, or for carrying out coatings of differing natures on each of the faces of the strip.

In fact, it is possible to ensure a perfectly sealed contact between the face of the strip opposite to its face to be coated and the lateral surface of the drum, at least in the lateral end parts of the strip. With this aim, the drum is coated, at least in its end parts, with a layer of flexible material such as an elastomer. The lateral parts of the strip near to its two borders are placed in contact with the parts of the drum which are coated with flexible and sealed matter, with a contact pressure sufficient to ensure a perfect seal. Thus, any infiltration of electrolytic liquid between the drum and the metal strip is avoided.

So as to supply the strip with electric current and keep it at a cathodic potential relative to the soluble anodes which are connected to the positive terminal of a source of direct current, it is necessary to ensure the placing in contact of the strip with an electrical conducting element which is itself electrically connected to the negative terminal of the source of direct electrolysis current.

The electrical placing in contact of the strip with the negative terminal of the source of current is generally performed by way of the drum for displacing the strip, which is submerged in the tank of the electrolysis cell. For this purpose, the drum comprises a metal alloy ferrule on its lateral surface, placed in a central position on the drum between its end parts coated by the flexible material of the elastomer type which is an electrical insulator.

In order to ensure a sealed contact between the strip and the surface of the drum in its end parts, the lateral layers of elastomer protrude slightly relative to the central ferrule ensuring the electrical contact of the strip. To place the strip in electrical contact with the central ferrule of the drum, it is therefore necessary to exert a sufficient pressure of the elastomeric lateral end parts to compress them so that the surface of the strip is in contact with the conducting ferrule over the whole surface of this ferrule.

Therefore, on either side of the drum, oppositely directed traction forces whose magnitude may be large must be exerted on the strip. These forces are exerted by way of guiding and tensioning rollers situated above the level of the liquid in the tank of the electrolysis cell, effecting a certain deflection of the strip on either side of the drum. These rollers also keep the strip on the drum, over a specified winding arc.

The traction exerted on the strip on either side of the drum generates large mechanical stresses in the body of the metal sheet, so much so that there is sometimes deterioration in the mechanical characteristics of this metal sheet.

Furthermore, the distribution of the electric field over the width of the conducting ferrule is not perfectly uniform and in particular, certain anomalies appear in the vicinity of the edges of the ferrule where the electric field increases substantially.

In the case of electrolysis cells with vertical arrangement of the anodes, it is known to bring the electric current to the strip by way of deflector rollers arranged above the level of the liquid in the tank of the cell. However, apart from the disadvantages related to the vertical arrangement of the anodes and of the strip in its part over which the coating is performed, such installations are very uneconomical in terms of electric power consumption. This heavy electrical power consumption is due in part to the fact that the current is brought to the strip by the deflector rollers in a zone substantially separated from the anodes.

An installation is also known comprising radial type cells in which the electric current is brought to the strip by way of rollers arranged on either side of the drum, these rollers for bringing current, associated with support rollers, being placed at a relatively small distance above the level of the liquid in the tank of the electrolysis cell and the ends of the anodes. However, the rollers for bringing cathodic current to the strip are of very small diameter and come into contact with the strip over a zone practically limited to a generatrix of the roller for bringing the current. It is therefore possible to pass only a relatively low intensity current in the strip, which limits the options of the installation as regards its productivity and the production of thick coating layers.

Moreover, although of radial type, the electrolysis cell uses insoluble anodes which require continuous regeneration of the electrolyte during the coating procedure.

In the case of a radial type electrolysis cell with soluble anodes, it has been proposed to use a drum coated with insulating material such as an elastomer over all its lateral surface and to bring the current to the strip coming into sealed contact with the drum, by way of two guiding rollers arranged above the level of the electrolytic liquid in the cell, ensuring the placing under tension of the strip and the holding of the winding arc of this strip on the drum.

In this arrangement, before its entrance into the bath of electrolytic liquid and at its exit, the strip is nipped between the corresponding guiding roller and the drum.

The guiding and tensioning rollers ensuring the bringing of the electric current to the strip are of small diameter relative to the diameter of the drum and must exert a relatively large traction on the strip to ensure a sealed contact of the strip with the drum and a passage of the electric current from the guiding rollers to the strip without arcing.

Furthermore, the metal strip arrives at the guiding rollers of the electrolysis cell and leaves this electrolysis cell in a substantially horizontal direction, which is not favourable in the case where several cells are arranged one after the other to constitute an installation for coating by deposition of successive layers on the strip.

Among the most commonly used electrolytes in the case of metal coatings and, in particular, in the case of electrogalvanizing, figure chloride baths and sulphate baths which offer essentially differing electrical and chemical properties.

Chloride electrolytes exhibit a much weaker electrical resistivity than sulphate electrolytes, which is generally reflected in a lesser power consumption when they are used in an installation for coating by electrolysis. On the other hand, the chlorides are generally more corrosive and cause more rapid wearing of the structures of the cells coming into contact with the electrolyte.

Hitherto, the advantages of the use of a chloride-based electrolyte have never been combined with those of a radial cell installation in which the strip to be coated is supplied with electric current by cylinders situated outside the electrolyte bath.

The aim of the invention is therefore to propose an installation for electrolytic coating of a metal strip and, in particular, an installation for electrogalvanizing a steel strip comprising at least one cell constituted by a tank containing electrolytic liquid, a horizontal axis rotating drum completely coated on its outer cylindrical lateral surface with an electrically insulating material and partially submerged in the electrolytic liquid, a set of soluble anodes made from coating metal in the form of ring segments arranged opposite the outer cylindrical surface of the drum in its submerged part with which the metal strip to be coated is kept in contact, means of supplying the anodes with electric current, means for injecting electrolytic liquid between the anodes and the metal strip in contact with the drum, in a counter-current sense with respect to the direction of circulation of the strip and electrical conducting roller sets in contact with the strip in a zone situated above the upper level of the electrolytic liquid in the tank which are electrically connected to means ensuring a circulation of the electric current in the metal strip and the setting of this strip to a cathodic potential relative to the soluble anodes, this installation making it possible to avoid exerting high magnitude traction forces on the strip in the region of the electrolysis cells as well as the formation of longitudinal lines on this strip due to the presence of a conducting ferrule on the outer surface of the drum.

With this aim, the electrical conducting roller sets are constituted, for each of the cells, by two electrically conducting deflector rollers over which passes the strip to be coated, each mounted rotatably about an axle parallel to the axle of the drum on either side of the drum and arranged, at least in part, below the upper level of the drum close to its outer surface, and two support rollers associated with each of the deflector rollers ensuring the holding of the strip against the deflector roller over a substantial part of its periphery and as far as a zone close to the part of the outer surface of the drum which is submerged in the electrolytic liquid.

The invention also relates to a process for electrolytic coating employing an installation according to the invention and using a chloride solution as electrolytic liquid.

In order to make the invention clearly understood, by way of non limiting example, there will now be described in relation to the appended figures, an embodiment of an installation according to the invention and its use for the production of metal sheets coated with at least one layer of zinc or a zinc alloy.

Figure 1:
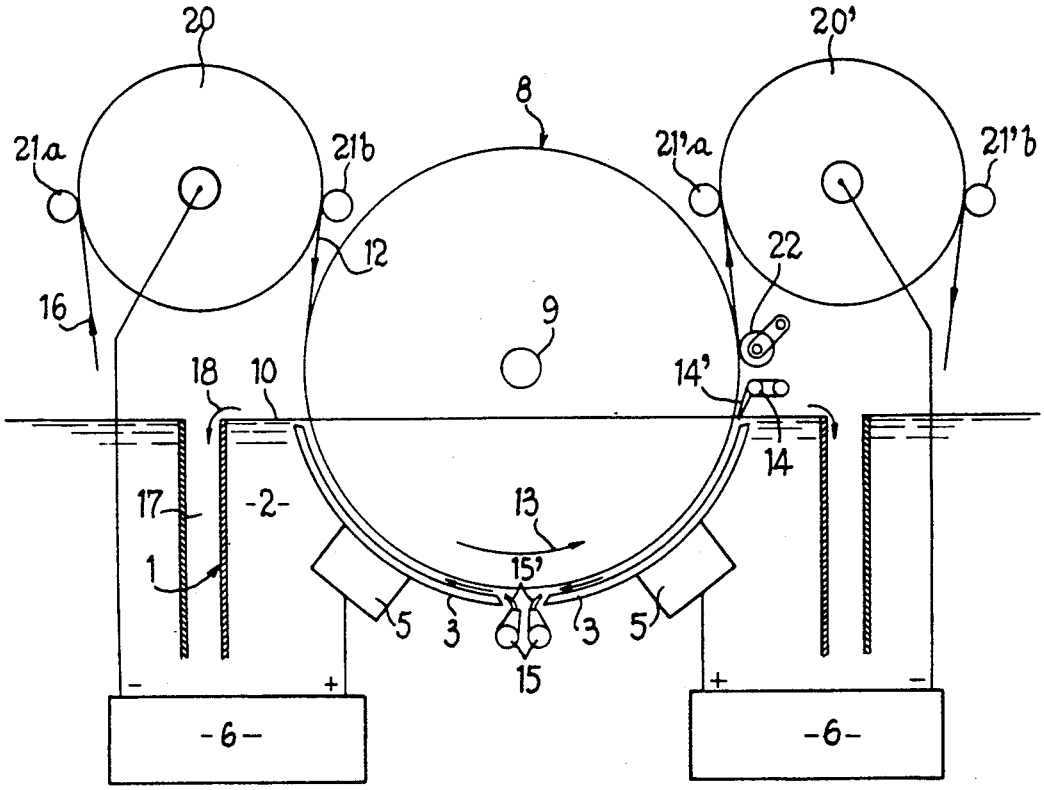
FIG. 1 is a schematic view in elevation of a cell of an electrogalvanizing installation according to the invention.

In FIG. 1 is represented schematically an electrolysis cell of an electrogalvanizing installation according to the invention.

The cell comprises a tank 1 only part of the lateral wall of which has been represented. The tank 1 contains an electrolytic liquid 2 of the chloride type containing $Cl^-$ ions in which are submerged soluble anodes 3 made from zinc or another metal.

The anodes 3 have the shape of circular ring segments constituting an arc of angular magnitude a little less than 90°.

The anodes 3 are arranged in pairs one after the other, with a slight spacing, so as to offer an active interior surface having an enveloping arc a little less than 180°. In a horizontal axial direction, the anodes 3 constitute a continuous active surface of cylindrical shape the width of which is at least equal to the width of the strip to be coated.

The soluble anodes 3 rest on two supporting elements 5 made from good electrically conducting material which are connected to the positive terminal of a source of direct current 6, so as to place the conducting elements 5 and the soluble anodes 3 in electrical contact with these elements, at an anodic potential and to pass the electrolysis current through the soluble anodes 3.

A drum 8 the diameter of which is slightly less than the diameter of the active cylindrical surface of the anodes 3 is rotatably mounted on the cell 1 by way of a horizontal axle 9. The drum 8 is arranged so that the level 10 of the electrolytic liquid 2 in the tank 1 lies slightly below the diametral plane of the drum 8.

The lateral surface of the drum 8 is completely coated with an insulating material which may preferably consist of an elastomer. The strip to be coated 16, for example a strip of sheet metal or of band steel, is placed in contact with the lateral insulating surface of the drum 8 the rotation of which in the direction of the arrow 13 enables the displacement of the strip inside the electrolyte bath 2, opposite the active surface of the anodes 3.

A first pad 14 for injecting electrolytic liquid is placed near the exit end of the anode segments 3 and comprises a set of injectors 14' enabling electrolytic liquid to be injected into the space made between the anode segment 3 and the exterior surface of the drum 8, over which passes the strip to be coated 16.

A second injection pad 15 is placed at the lower part of the drum, in the zone situated between the lower end parts of the anode segments 3. The pad 15 is a double pad comprising injectors 15' at the level of each of the anode segments 3, inversely directed for each of the parts of the double pad 15.

In the case where the drum turns in the direction of the arrow 13, which corresponds to the direction of unwinding 12 of the strip, the injectors 15' connected to the pad 15 situated to the left in FIG. 1 are put into operation. In this way, the electrolytic liquid circulates in a counter-current sense relative to the direction of circulation of the strip, in the whole of the annular space situated between the anodes 3 and the drum.

The level 10 of the electrolytic liquid in the tank 1 of the electrolysis cell corresponds to an overflow level of this liquid into a space 17 (arrow 18) in which the electrolytic liquid is recovered in order to be reinjected by the pads 14 and 15.

The course of the strip 16, on either side of the drum 8, is defined by deflector rollers 20 and 20' also ensuring the placing in contact of the strip 16 with the surface of the drum 8, with a certain support pressure.

Two support rollers **21*a* and 21*b* ensure the holding of the strip 16 on the deflector roller 20, over a certain winding arc. Similarly, two support rollers 21'*a* and 21'*b* ensure the holding of the strip 16 on the deflector roller 20'** at the exit of the electrolysis cell.

According to one of the characteristics of the invention, the deflector rollers 20 and 20' are each connected to the negative terminal of one of the sources of direct current 6, so as to bring the strip to a cathodic potential and make the electrolysis current pass in the strip 16, the rollers 20 and 20' consisting entirely of a conducting material.

A squeezing roller 22 arranged on the path of the strip 16 at the exit of the electrolysis cell makes it possible to avoid the entrainment of electrolyte by the strip 16 on exiting the electrolyte bath 2.

In FIGS. 2 to 5 is seen an installation for electrolytic coating according to the invention, which may be used to coat a steel strip with a layer of zinc or zinc alloy on one of its faces or on its two faces.

This installation comprises successive electrolysis cells the general structure of which is identical to the structure which has been described and which is represented in FIG. 1. The corresponding elements in FIG. 1 and in FIGS. 2 to 5 carry the same labels.

Figure 2:
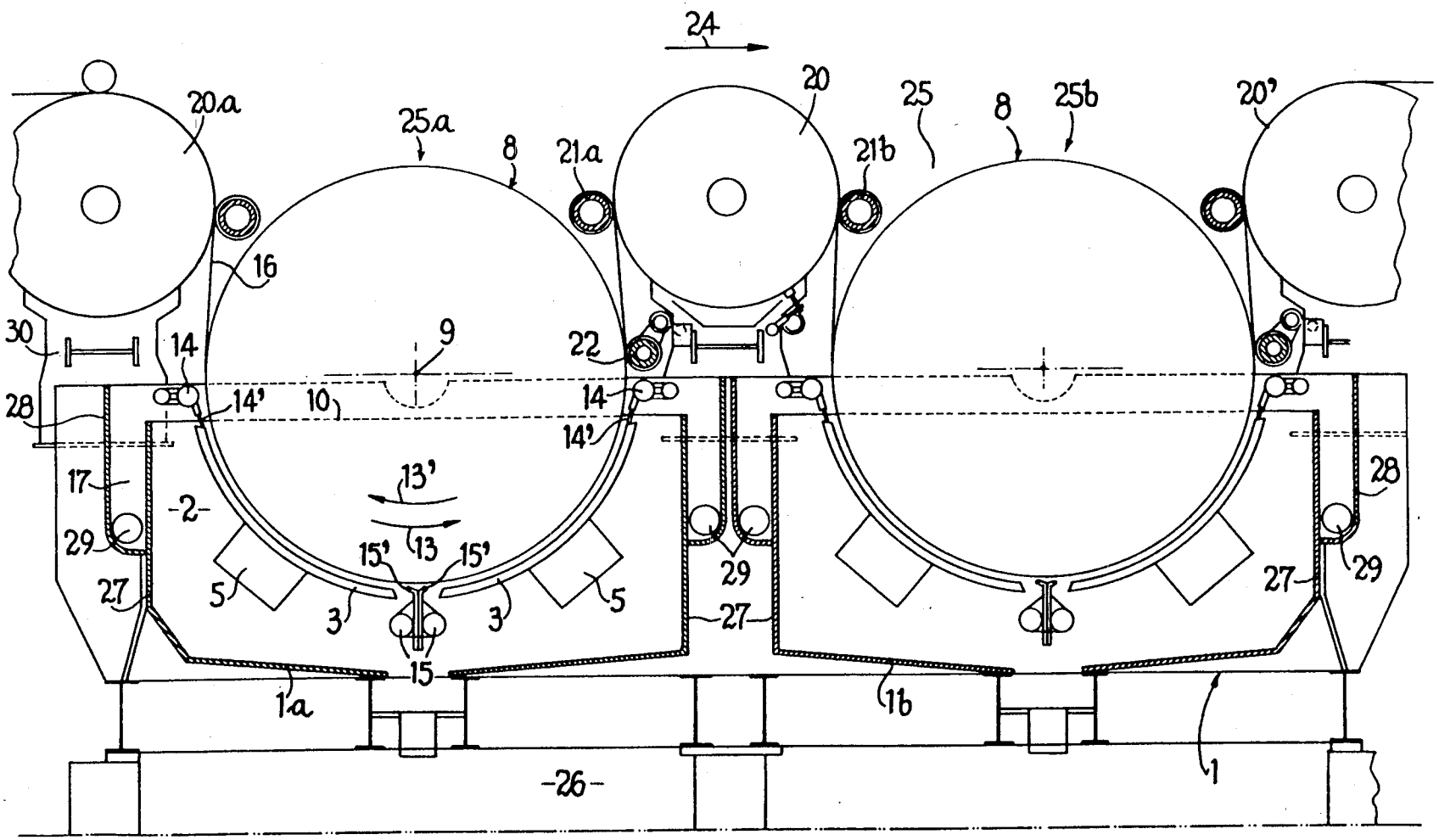
FIG. 2 is a view in elevation and in partial section of the entrance part of an electrogalvanizing installation according to the invention showing two successive electrolysis cells.

In FIG. 2 has been represented the entrance part of the installation comprising the first two electrolysis cells, in the direction of circulation of the strip symbolized by the arrow 24.

The tanks **1*a* and 1*b* of the two successive electrolysis cells 25*a* and 25*b* rest on a common structure 26** constituting the support of the installation for coating the strip.

The tanks 1*a* and 1*b* of the two successive cells comprise vertical end walls 27, the upper level of which determines the overflow level of the electrolytic liquid 2 into a space 17 defined by a wall 28 fixed onto the exterior surface of the wall 27.

A duct 29 for recovering electrolytic liquid is arranged at the lower part of each of the spaces 17 defined by a wall 28.

The electrolytic liquid recovered by the ducts 29 may be returned by pumps to the injection pads 14 and 15 which operate in the way which has been described above.

It should be noted that two pads 14 are associated with each of the electrolysis cells 25 and are arranged on either side of the drum 8 so that the injectors 14' are directed towards the inside of the corresponding end parts of the anodes 3. On the other hand, the injection pad 15 is a double pad comprising injectors 15' directed in differing directions and capable of injecting electrolytic liquid into the space existing between the strip 16 and the active surface of the corresponding anode segment, in differing directions.

This arrangement of the injection pads 14 and 15 makes it possible to use the installation just as well in the direction of circulation of the strip represented by the arrow 24 as in the opposite direction.

Whatever the direction of the circulation of the strip 16 it will be possible to ensure the circulation of an electrolyte current in the direction inverse to the direction of circulation of the strip by using one or the other of the injection pads arranged on either side of the drum and the pad 15 the injectors 15' of which are directed in the corresponding direction. In the case where the installation operates so that the strip circulates in the direction inverse to the arrow 24, the end of the installation represented in FIG. 3 corresponds to its exit end and the drum 18 entraining the strip 16 is set in rotation in the direction of the arrow 13'.

On either side of each of the electrolytic cells 25, the deflector rollers 20 and 20' of the strip are rotatably mounted about a horizontal axle parallel to the axle 9 of the drum 8, on a support 30 integral with the support structure 26 of the installation.

The deflector rollers 20, 20' are preferably motorized so as to facilitate the circulation of the strip 16 and avoid slippage of this strip on the deflector roller.

The deflector rollers 20 and 20', generally consisting of steel, are electrically connected as has been explained in relation to FIG. 1, to the negative terminal of a high power source of direct current capable of providing a very strong current under a voltage specified by the optimal conditions for employing the electrolysis carried out inside the cell.

As is visible in FIG. 2, the deflector rollers 20 and 20' have a large diameter, this diameter being, in the case of the installation described, a little greater than the radius of the drum 8 of the electrolysis cell.

The deflector rollers 20 and 20' are on the other hand placed so that at least part of the roller, and preferably a substantial part, is situated at a lower level than the upper level of the drum 8. However, the deflector rollers 20 and 20' are arranged above the upper end of the walls 27 of the tank 1 and therefore entirely above the level 10 of the electrolyte in the corresponding tank 1.

Each of the successive deflector rollers 20 and 20' with the exception of the initial roller 20*a* (and of the roller placed at the exit of the installation, not visible in FIG. 2), constitutes at one and the same time the entrance roller of one electrolytic cell and the exit roller of the preceding electrolytic cell. For example, the roller 20 represented in FIG. 3 constitutes the entrance roller of the electrolytic cell 25*b* and the exit roller of the electrolytic cell 25*a*.

The strip of sheet metal 16 is substantially 180° reversed by the successive deflector rollers 20 and 20' with the exception of the initial roller 20*a* which ensures a 90° reversal of the strip 16.

The support rollers 21*a* and 21*b* placed on either side of the deflector roller 20 ensure that the strip 16 is hard up against the roller 20 over an arc at least equal to 190°. A large contact area is thus obtained between the strip 16 and the roller 20 because this roller has a large diameter and a winding arc of large magnitude. It is therefore possible to pass a very high intensity cathodic current in the strip.

Figure 3:
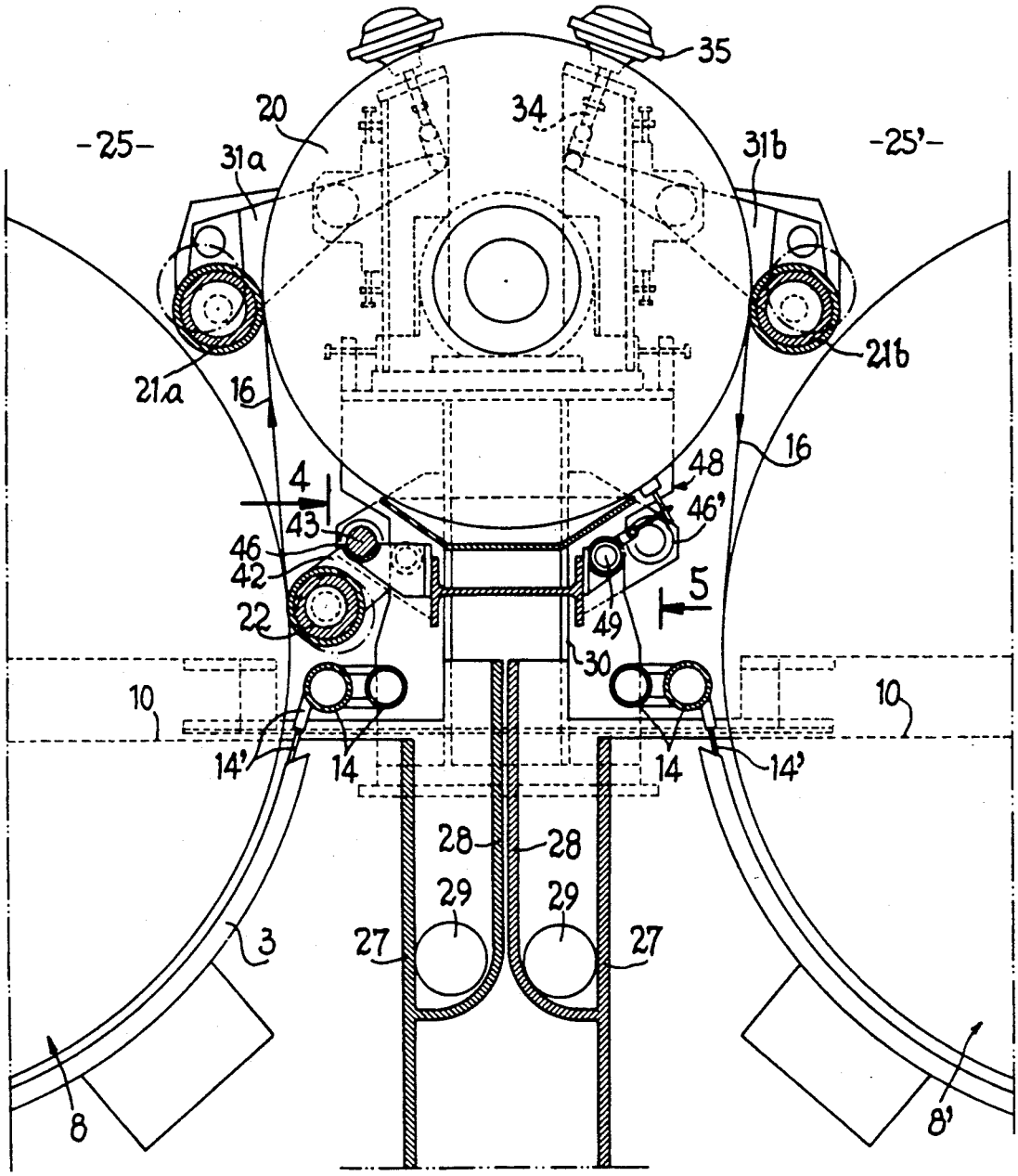
FIG. 3 is an enlarged view of a part of FIG. 2 showing in particular a deflector and conducting roller associated with two successive cells of the installation represented in FIG. 2.

On referring to FIG. 3, a deflector roller 20 constituting the exit roller of a first electrolysis cell 25 and the entrance roller of the following electrolysis cell 25' is seen. The deflector roller 20, the diameter of which is slightly greater than half the diameter of the drums 8 and 8' of the cells 25 and 25' is arranged on its support 30 in such a way that a substantial part of the roller 20 is arranged at a lower level than the upper level of the drums 8 and 8'. The deflector roller 20 is interposed between the drums 8 and 8' in such a way that part of its lateral surface is close to the lateral surface of the drum 8 and another part of its surface is close to the exterior surface of the drum 8'. The axis of rotation of the deflector roller 20 is in a vertical plane equidistant from the end walls 27 of the successive cells 25 and 25'.

Furthermore, the support rollers 21*a* and 21*b* which have been represented in FIG. 3 with continuous lines in their working position ensure, in this position, the contact of the strip 16 with the lateral surface of the deflector roller 20 over two generatrices situated below the horizontal diametral plane of the deflector roller 20. In this way, the strip 16 is kept in contact with the large diameter deflector roller 20 over a length of arc greater than 180° and generally near to or a little greater than 190°.

Figure 4:
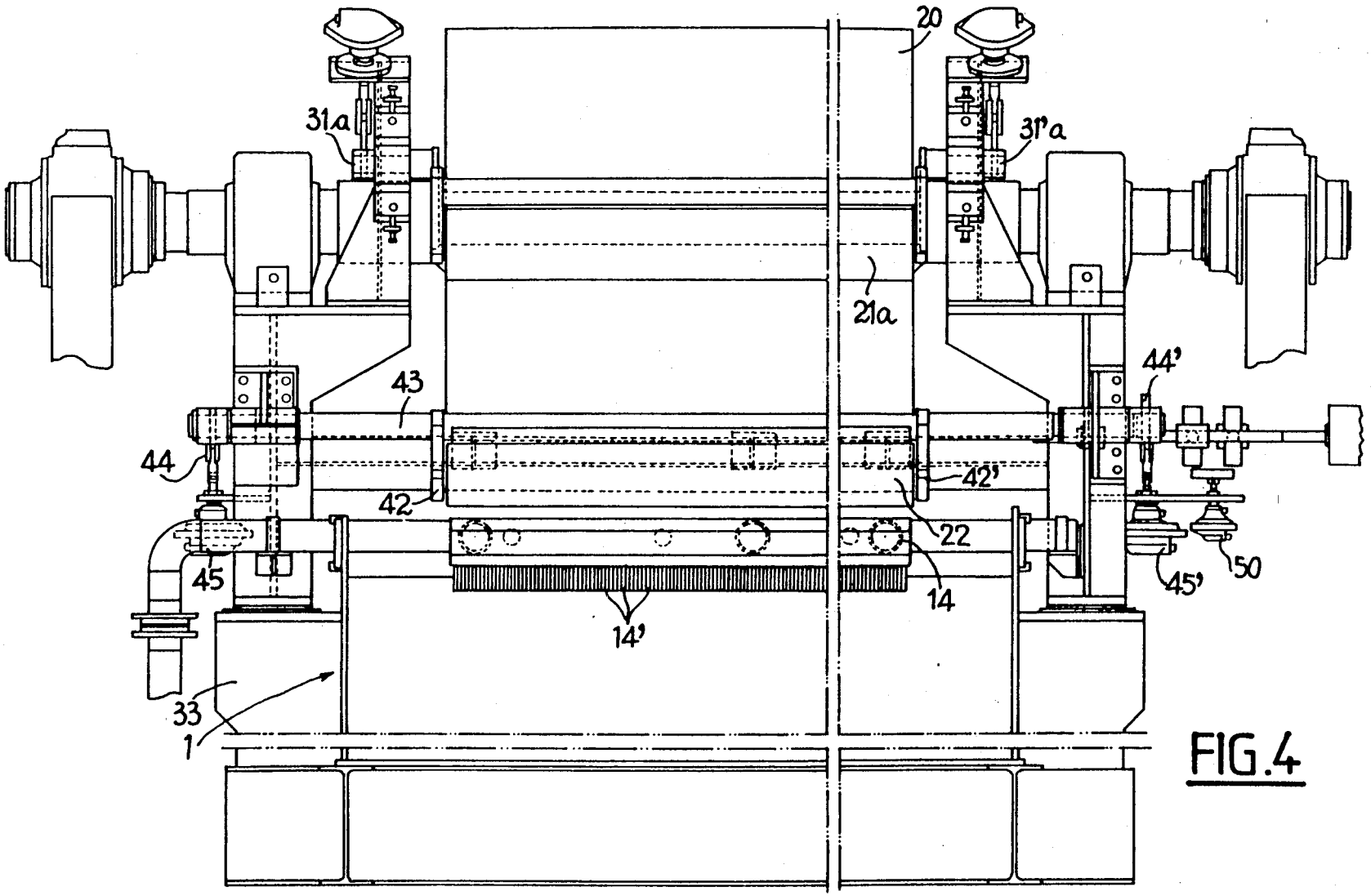
FIG. 4 is a side view in elevation along 4 of FIG. 3.
Figure 5:
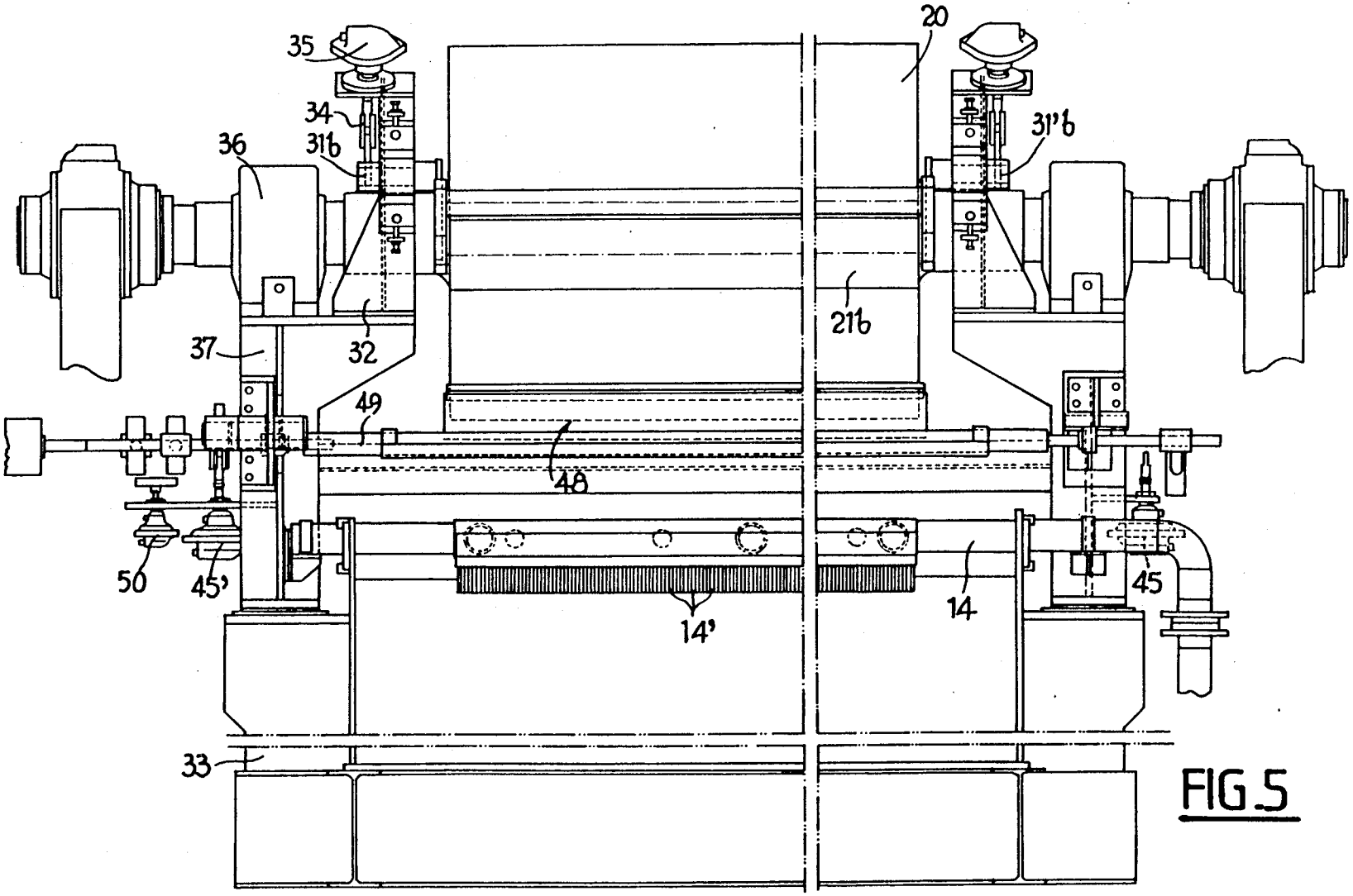
FIG. 5 is a side view in elevation along 5 of FIG. 3.

Furthermore, as is visible in FIGS. 4 and 5, the support rollers 21*a* and 21*b* are in contact with the deflector roller 20 over all of its length so that the contact area between the strip 16 and the deflector roller 20 is of very large size. It is therefore possible to pass a very high intensity electric current between the conducting roller 20 connected to the source of direct current and the circulating steel strip 16.

Furthermore, the support rollers 21*a* and 21*b* ensure a perfect contact of the strip with the deflector roller without it being necessary to exert a large traction on the strip. The possibility of arcing between the strip and the roller is thus diminished. Furthermore, the density of cathodic current passing from the roller to the strip may be reduced insofar as the contact area is large.

On the other hand, the support rollers are arranged in a small width gap defined by the opposing surfaces of the deflector roller and corresponding drum. This arrangement near the zone in which the deflector roller is closest to the drum makes it possible to ensure an effective contact between the strip and the deflector roller through which the strip is supplied with electric electrolysis current, in a zone close to the part of the drum 8 or 8' submerged below the level 10 of the electrolyte bath in the cells 25 and 25'. The electric current therefore traverses a small length of the strip 16 before arriving in the annular zone in which the electrolysis takes place situated between the soluble anodes 3 and the corresponding drum 8 or 8', this zone comprising an upper entrance part situated just below the level 10 of the electrolyte bath. Electric current losses are thus avoided, so that the energy efficiency of the process remains very satisfactory despite a cathodic supply of the strip outside the electrolyte bath. This result is moreover obtained without having to exert a large traction on the strip, the electrical contact of the strip and of the deflector and conducting roller 20 being ensured by the support rollers.

In FIGS. 3, 4 and 5 it is seen that the support rollers 21*a* and 21*b* are fixed at their longitudinal ends onto lever arms 31*a* and 31'*a* as far as the support roller 21*a* is concerned, and 31*b* and 31'*b* as far as the roller 21*b* is concerned, the lever arms themselves being hinged about a horizontal axis on a corresponding support 32 resting on the fixed stand 33 of the installation.

The end of each of the levers 31*a*, 31'*a*, 31*b*, 31'*b* opposite to the end connected to the corresponding support rollers 21*a* or 21*b* is hinge-connected, about a horizontal axis, to the bar 34 of a jack 35.

By extension or retraction of the bars 34 of the jacks 35 associated with a support roller 21*a* or 21*b*, this roller can be displaced between its working position, represented with continuous lines in FIG. 4 in which the roller ensures the bearing of the strip 16 on the deflector roller 20, and an idle position, represented with broken lines in FIG. 4, in which the corresponding support roller is separated from the lateral surface of the deflector roller 20 and is no longer in contact with the strip of sheet metal 16.

The jacks 35 for actuating the support rollers are mounted on the upper part of the support 32 resting on the stand 33 of the installation.

The bearings 36 in which are mounted the ends of the shaft of the deflector roller 20 also rest on the stand 33 of the installation, by way of a support 37 onto which is fixed the support 32 of the support rollers.

As is visible in FIGS. 3 and 4, a squeezing roller 22 is rotatably mounted about a horizontal axle parallel to the axle of the deflector roller 20 and of the drum 8', between two end flanges 42 and 42' integral with an axle 43 parallel to the axle of the deflector roller 20, the ends of which are fixed onto a lever arm 44 or 44' hinge-connected to the bar of an actuating jack 45 or 45' fixed, by way of a support, onto the fixed stand 33 of the installation.

The actuation of the jacks 45 and 45' makes it possible to rotate the axle 43 in one direction or in the other in such a way as to displace the squeezing roller 22 between its working position, represented with continuous lines in FIG. 3, in which the roller 22 is in contact with the strip of sheet metal 16, and an idle position in which the roller 22 is no longer in contact with the strip 16.

The squeezing roller comprises a tubular metal core rotatably mounted by way of bearings on the axle of the roller 22 the ends of which are fixed onto the flanges 42 and 42' and an exterior coating made of flexible material coming into contact with the metal strip 16, in the working position of the squeezing roller.

In this position, the squeezing roller comes into contact with the strip 16 in the part of this strip entering into contact with the drum 8, immediately above the level 10 of the electrolyte bath and of the end of the soluble anodes 3. In this way, the strip 16 is nipped between the squeezing roller 22 and the drum 8, so that it is possible to exert a relatively high squeezing pressure on the metal sheet, by way of the exterior flexible surface of the squeezing roller 22, by virtue of the actuating jacks 45 and 45'.

Furthermore, the arrangement of a single squeezing roller bearing on the drum 8 in a zone situated just above the level 10 of the electrolyte makes it possible to increase the efficiency of the squeezing of the strip when it exits from the electrolysis cell, whilst however avoiding lengthening the length of the strip of sheet metal 16 between the corresponding support roller 21*a* and the annular electrolysis zone.

This arrangement of the squeezing roller makes it possible to avoid the use of nipping and squeezing rollers in a free part of the strip situated between the deflector roller and the drum.

As is visible in FIGS. 3 and 5, the installation furthermore comprises an assembly for sanding down 48 the lateral surface of the deflector roller 20, integral with an axle 49 rotatably mounted at its ends in supports 46' similar to the supports 46 receiving the end parts of the axle 43 for supporting and positioning the squeezing roller 22.

The sanding assembly 48 fixed on the axle 49 may be displaced between an active position in contact with the corresponding deflector roller and an inactive position separated from the roller by virtue of jacks such as 50 connected to the ends of the axle 49 by way of hinged rods.

The squeezing roller 22 and the sanding assembly 48 with the deflector roller 20 are placed on either side of the vertical plane of symmetry of the roller 20.

It should be noted that the supports 46 and 46' comprise apertures enabling the mounting in these supports situated on either side of the plane of symmetry of the deflector roller 20, of either the squeezing assembly 43, 42, 22, or of the sanding assembly, 48, 49.

When the direction of circulation of the strip 16 through the installation is reversed, it is necessary to interchange the position of the squeezing assembly and of the sander assembly which are associated with a deflector roller, which can be easily and rapidly carried out by straightforward demounting and remounting of the axles 43 and 49 on the corresponding supports 46 and 46'.

It may be possible to resort to a slightly different mounting and to use a single jack to effect the displacement and the positioning of the squeezing assembly and of the sander assembly.

In FIGS. 4 and 5, the injection assemblies 14 arranged at the entrance and at the exit of the drums 8 and 8' respectively have likewise been represented. These injection assemblies comprise a very large number of small diameter injectors 14 opening out into the annular electrolysis space defined by the corresponding drum and the metal sheet on the one hand, and the inner active surface of the soluble anodes on the other hand.

As has been explained earlier, one of the assemblies 14 is put into operation according to the direction of circulation of the strip 16 in the installation.

Advantageously, it will be possible to employ the installation according to the invention by using an electrolytic bath consisting of a chloride possessing a good electrical conductivity. A very good energy efficiency of the installation can thus be obtained, insofar as the electrical losses arising from the power supply to the strip outside the bath are limited to a relatively low value.

Furthermore the employing of the installation according to the invention offers all the advantages of the known processes with radial cells, in particular as far as the production of a high quality coating on one of the faces of the strip is concerned. Furthermore, the installation according to the invention makes it possible to avoid the disadvantages of the known processes with radial cells using a conducting ferrule wound on the drum, that is to say the need to exert large tractions on the strip and the formation of longitudinal lines corresponding to ferrule marks.

The installation according to the invention may comprise a large number of cells, which enables the speed of circulation of the strip and hence the productivity of the installation to be increased.

This installation may moreover be very easily and very rapidly adjusted to one or other direction of circulation of the strip to be coated.

The installation and the process according to the invention may easily be adjusted to the production of a metal sheet coated on its two faces by identical or differing layers consisting for example of zinc or layers of zinc containing iron or nickel.

It is clearly understood that the invention is not limited to the embodiment which has been described.

The size and arrangement of the deflector rollers and of the support rollers associated with these deflector rollers may be different from those which have been described, it being possible for the winding arc of the strip on the deflector rollers to have a variable value.

The squeezing rollers situated at the exit of the electrolysis cells may be constructed in a different way from that which has been described and similarly the circulation of the electrolyte in the annular zone situated between the drum and the soluble anodes may be effected in a different way from that which has been described.

The installation according to the invention may be used with differing electrolytes of chloride solutions and it will be possible to specify in usual fashion the electrical parameters for driving the process, as a function of the running conditions of the installation.

Finally, it will be possible to use the installation and the process according to the invention not only for the electrogalvanizing of steel sheets but also in the case of the production of a metal coating of any nature on a sheet or band of steel or on any other metal support in the form of a strip of great length.

We claim:

1. Installation or electrolytic coating of a metal strip (16) and, in particular, installation for electrogalvanizing a steel strip comprising at least one cell (25) constituted by a tank (1) containing electrolytic liquid (2), a horizontal axis rotating drum (8, 8') completely coated on its outer lateral surface with an electrically insulating material and partially submerged in the electrolytic liquid (2), a set of soluble anodes (3) made from coating metal in the form of ring segments arranged opposite the outer cylindrical surface of the drum (8, 8') in its submerged part with which the metal strip (16) to be coated is kept in contact, a means (6) of supplying the anodes (3) with electric current, means (14, 15) for injecting electrolytic liquid between the anodes (3) and the metal strip (16) in contact with the drum (8), in a counter-current sense with respect to the direction of circulation of the strip (16) and electrical conducting roller sets (20, 21) in contact with the strip (16) in a zone situated above the upper level (10) of the electrolytic liquid (2) in the tank (1) which are electrically connected to a means (6) ensuring a circulation of the electric current in the metal strip (16) and the setting of this strip (16) to a cathodic potential relative to the soluble anodes (3), characterized in that the electrical conducting roller sets (20, 21) are constituted, for each of the cells (25), by two electrically conducting deflector rollers (20) each mounted rotatably about an axle parallel to the axle of the drum (8, 8') on either side of the drum (8, 8') and arranged, at least in part, below the upper level of the drum (8, 8') close to its outer surface, and two support rollers **(21*a*, 21*b*) associated with each of the deflector rollers (20, 20') ensuring the holding of the strip (16) against the deflector roller (20, 20') over a substantial part of its periphery and as far as a zone close to the part of the outer surface of the drum (8, 8')** which is submerged in the electrolytic liquid.

2. Installation according to claim 1, characterized in that the support rollers **(21*a*, 21*b*) are rotatably mounted at the end of lever arms (31*a*, 31'*a*, 31*b*, 31'*b*) hinged to a fixed stand (33) of the installation and connected at their ends opposite to the rollers (21*a*, 21*b*) to actuating jacks (35) for displacing the support rollers between a working position in contact with the strip (16) and an idle position separated from the strip (16) passing over the corresponding deflector roller (20)**.

3. Installation according to claim 1, characterized in that a squeezing roller (22) whose axle is parallel to the axle of the drum (8) is placed so as to come into contact with the face of the strip (16) on which the coating is carried out, in a zone in which the strip (16) is in contact with the drum (8), situated above the upper level (10) of the electrolyte in the tank (1) of the cell (25) and below the support roller **(21*a*) ensuring the holding of the strip (16) against the deflector roller (20), on the side of the drum (8) corresponding to the exit of the electrolysis cell (25)**.

4. Installation according to claim 3, characterized in that the squeezing roller (22) is rotatably mounted on an axle integral at its ends with flanges (42, 42') fixed onto a shaft (43) connected to actuating jacks (45, 45') so as to displace the roller (22) between a working position in which the roller (22) is placed in contact with the strip (16) under a certain pressure and an inactive position in which the roller (22) is separated from the strip (16).

5. Installation according to claim 1, characterized in that the support rollers **(21*a*, 21*b*) are arranged relative to the corresponding deflector rollers (20) so as to keep the strip (16) on the deflector roller (20)** over a winding arc of magnitude greater than 180°.

6. Installation according to claim 1, characterized in that each of the deflector rollers (20) interposed between two drums (8) of two successive electrolysis cells **(25*a*, 25*b*)** imparts a substantially 180° reversal to the strip in the vertical direction.

7. Installation according to claim 1, characterized in that the conducting defector rollers (20, 20') have a diameter at least equal to half of the diameter of the corresponding drum (8, 8').

8. Installation according to claim 1, characterized in that it comprises, for each of the cells (25), a squeezing assembly (20) and at least one means (14, 14') for injecting electrolytic liquid between the anodes (3) and the strip (16) which are adjustable so as to enable a change in the direction of circulation of the strip (16) in the installation comprising successive electrolysis cells (25).

* * * * *